US008141641B2

(12) United States Patent
Chan et al.

(10) Patent No.: US 8,141,641 B2
(45) Date of Patent: Mar. 27, 2012

(54) BACKUP SAFETY FLOW CONTROL SYSTEM FOR CONCENTRIC DRILL STRING

(75) Inventors: Kwong O. Chan, Edmonton (CA); Henry X. He, Edmonton (CA)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 12/689,083

(22) Filed: Jan. 18, 2010

(65) Prior Publication Data

US 2010/0116501 A1 May 13, 2010

Related U.S. Application Data

(62) Division of application No. 12/131,583, filed on Jun. 2, 2008, now Pat. No. 7,647,989.

(51) Int. Cl.
*E21B 34/00* (2006.01)

(52) U.S. Cl. ..... 166/318

(58) Field of Classification Search ..... 166/193, 166/318; 175/317, 318, 324, 57, 218
See application file for complete search history.

(56) References Cited

U.S. PATENT DOCUMENTS

| | | | |
|---|---|---|---|
| RE28,768 | E | 4/1976 | Mason |
| 3,970,335 | A | 7/1976 | Curington et al. |
| 4,015,673 | A | 4/1977 | Craig, Jr. et al. |
| 4,321,974 | A | 3/1982 | Klemm |
| 4,343,357 | A | 8/1982 | Yeates |
| 4,462,472 | A | 7/1984 | Beimgraben |
| 4,509,606 | A | 4/1985 | Willis |
| 4,596,294 | A | 6/1986 | Russel |
| 4,705,119 | A | 11/1987 | Kostylev et al. |
| 4,709,768 | A | 12/1987 | Kostylev et al. |
| 4,790,391 | A | 12/1988 | Hamamura et al. |
| 4,848,486 | A | 7/1989 | Bodine |
| 4,854,397 | A | 8/1989 | Warren et al. |
| 4,936,397 | A | 6/1990 | McDonald et al. |
| 5,042,597 | A | 8/1991 | Rehm et al. |
| 5,148,875 | A | 9/1992 | Karlsson et al. |
| 5,165,491 | A | 11/1992 | Wilson |
| 5,407,021 | A | 4/1995 | Kane et al. |
| 5,435,400 | A | 7/1995 | Smith |
| 5,538,091 | A | 7/1996 | Theocharopoulos |
| 5,615,739 | A | 4/1997 | Dallas |

(Continued)

*Primary Examiner* — Thomas Beach
*Assistant Examiner* — James Sayre
(74) *Attorney, Agent, or Firm* — Bracewell & Giuliani LLP

(57) ABSTRACT

A technique is presented for providing a double-barrier to formation fluids during drilling operations with a concentric drill string having an inner bore and an annulus. A primary flow control system is used to provide a first barrier to formation fluids in the inner bore and annulus of the drill string. A backup flow control system is used to provide a second barrier to formation fluids. The backup flow control system comprises a backup inner bore shutoff valve and a backup annulus shutoff valve. The backup inner bore shutoff valve is dropped from the surface through the inner bore of the drill string. The backup inner bore shutoff valve has spring-biased tabs that are configured to extend outward to contact an inner surface profile of the inner bore of the drill string. The backup annulus shutoff valve may be provided with the profile to receive the spring-biased tabs from the backup inner bore shutoff valve. When the tabs of the backup inner bore shutoff valve are disposed opposite the profile, the tabs of the backup inner bore shutoff valve are extended outward into the profile by a spring assembly, securing the backup inner bore shutoff valve within the drill string.

4 Claims, 7 Drawing Sheets

U.S. PATENT DOCUMENTS

| | | | | |
|---|---|---|---|---|
| 5,957,226 | A | 9/1999 | Holte | |
| 6,047,784 | A | 4/2000 | Dorel | |
| 6,186,237 | B1 | 2/2001 | Voss et al. | |
| 6,209,660 | B1 | 4/2001 | Cox | |
| 6,209,665 | B1 | 4/2001 | Holte | |
| 6,601,652 | B1 | 8/2003 | Moore et al. | |
| 6,918,452 | B2 | 7/2005 | Chan et al. | |
| 6,935,423 | B2 | 8/2005 | Kusmer | |
| 7,017,682 | B2 | 3/2006 | Chan et al. | |
| 7,090,033 | B2 | 8/2006 | Chan et al. | |
| 2004/0112644 | A1* | 6/2004 | Chan et al. | 175/57 |
| 2006/0201711 | A1* | 9/2006 | Vail | 175/57 |

* cited by examiner

BACKUP SAFETY FLOW CONTROL SYSTEM FOR CONCENTRIC DRILL STRING

BACKGROUND

The invention relates generally to shutoff valves for wells. In particular, the invention relates to a backup shutoff valve system for a concentric drill string and a method for installing and using the backup shutoff valves in a concentric drill string.

Most oil and gas wells are drilled with a rotary drilling rig. Typically, the drilling rig uses a string of drill pipe with a drill bit on the end. The drill string is rotated by the rotary drilling rig to rotate the drill bit into the ground. A drilling fluid is used to maintain control of the wellbore fluids in the well, as well as to remove the cutting from the wellbore. The drilling fluid may be pumped down the interior passage of the drill pipe, so that it may exit the drill bit through nozzles in the drill bit. The drilling fluid and cuttings are returned to the surface in the annulus space surrounding the drill pipe in the wellbore.

In many cases, the drilling fluid is a liquid known as drilling mud. The density, or weight, of the drilling mud is selected to provide a hydrostatic pressure that is greater than the expected pressure of the fluid in the formation surrounding the wellbore. Consequently, the drilling mud will provide sufficient pressure to prevent a blowout from the well. However, drilling mud can damage the formation around the wellbore, thereby reducing the ability to retrieve fluids later when the well is put into production. For example, methane typically is located in fairly deep coal beds. If liquid drilling mud is used, the coal beds may be damaged by the encroaching drilling mud from the wellbore.

In such circumstances, a gas, such as air, may be used as the drilling fluid. In one such technique, a drill sting with concentric strings of drill pipe: an inner drill string and an outer drill string; is used. The air is pumped down an annulus passage between the two strings of drill pipe. The air and cuttings are returned to the surface within the inner drill string. However, the opposite arrangement may also be used.

Because a column of air does not have the hydrostatic pressure of heavy drilling mud, valve assemblies have been developed to control the flow of fluid within the inner drill string and in the annulus between the inner and outer drill strings in the event that formation fluid begins to flow into the drill string, such as during a blowout or "kick." However, problems have been experienced with these valve assemblies. For example, these drill string valve assemblies have been known to leak.

Therefore, a more effective technique is desired for preventing an uncontrolled flow of formation fluid upward from the formation to the surface through a concentric drill string. The techniques describe below attempt to solve this problem.

BRIEF DESCRIPTION

A technique is presented for providing a double-barrier to formation fluids in a concentric drill string having an inner bore and an annulus. The technique prevents formation fluids from flowing uncontrollably upward through the concentric drill string to the surface. The first barrier to formation fluids is a primary flow control system that is provided to prevent formation fluids from flowing to the surface during a well excursion. The primary flow control system comprises a primary inner bore shutoff valve and a primary annulus shutoff valve. The primary inner bore shutoff valve may be used to block fluid flow through the inner bore of the concentric drill string. The primary annulus shutoff valve may be used to block fluid flow through the annulus of the concentric drill string.

The technique also utilizes a backup flow control system to provide a second barrier to formation fluids. The backup flow control system comprises a backup inner bore shutoff valve and a backup annulus shutoff valve. In the illustrated embodiment, the backup inner bore shutoff valve is dropped from the surface through the inner bore of the drill string. The backup inner bore shutoff valve has spring-biased tabs that are configured to extend outward to contact an inner surface profile of the inner bore of the drill string. In the illustrated embodiment, the backup annulus shutoff valve is provided with the profile to receive the spring-biased tabs from the backup inner bore shutoff valve. When the tabs of the backup inner bore shutoff valve are disposed opposite the profile, the tabs of the backup inner bore shutoff valve are extended outward into the profile by a spring assembly. This secures the backup inner bore shutoff valve within the drill string. Once secured within the drill string, the backup inner bore shutoff valve and backup annulus shutoff valves provide a second barrier to formation fluids. The backup inner bore shutoff valve may be used to block fluid flow through the inner bore of the concentric drill string and the backup annulus shutoff valve may be used to block fluid flow through the annulus of the concentric drill string.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
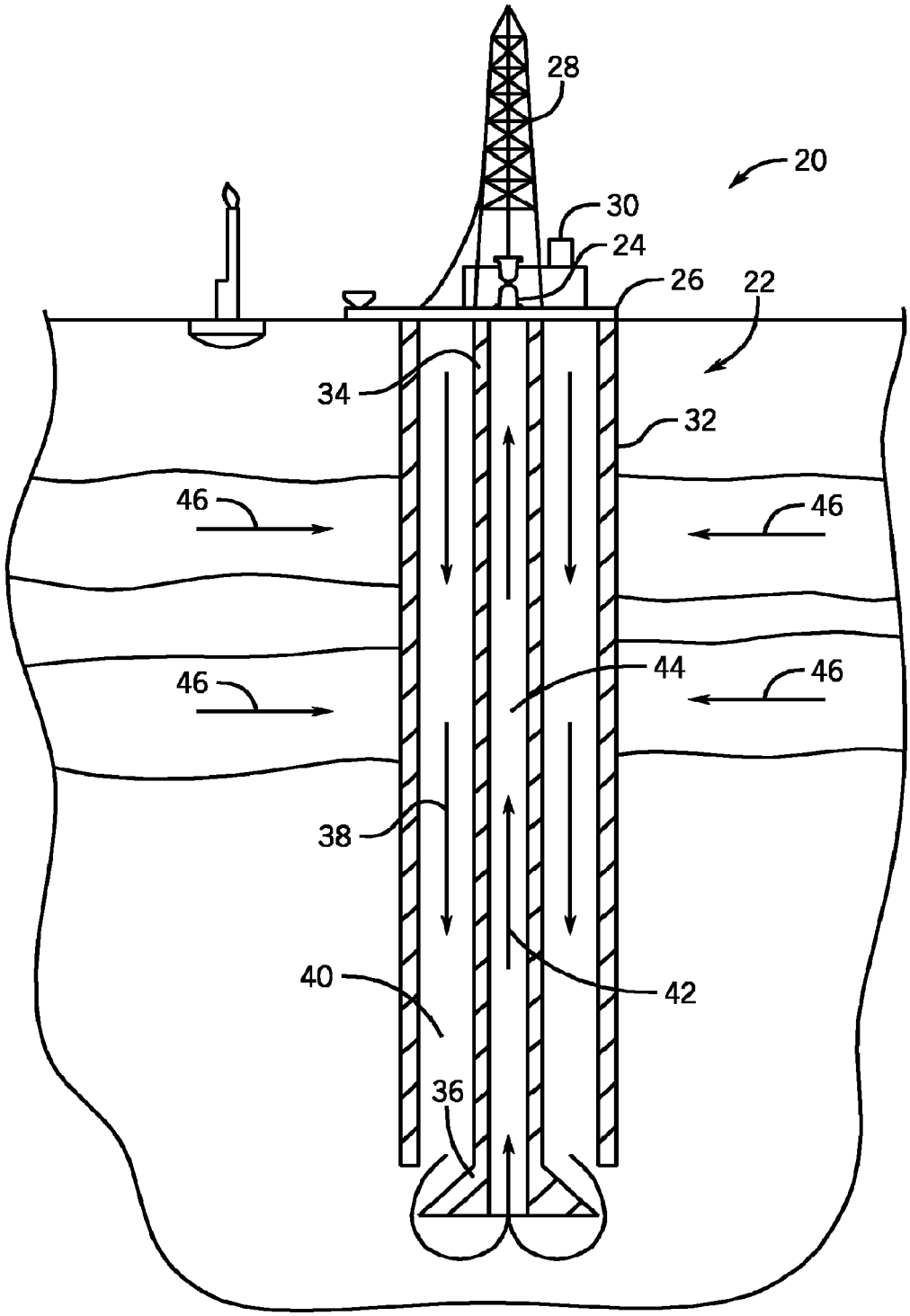
FIG. 1 is an elevation view of a well having a concentric drill string, in accordance with an exemplary embodiment of the present technique.

Referring now to FIG. 1, the present invention will be described as it might be applied in conjunction with an exemplary technique, in this case a drilling system for drilling wells, as represented generally by reference numeral 20. In the illustrated embodiment, the drilling system 20 comprises a concentric drill string 22. The drill string 22 is rotated by a rotary table 24 supported by a drilling platform 26. The drilling system 20 also comprises a derrick 28 to support the drill string 22 and its components during assembly and disassembly of the drill string 22. The illustrated system 20 also comprises a drilling fluid supply and recovery system 30. In this embodiment, the drilling fluid is a gas, such as air. However, other drilling fluids may be used.

In the illustrated embodiment, the drill string 22 is a concentric drill string having an outer housing 32 secured to an inner drill string 34. The drill string 22 also comprises a drill bit 36. As the drill string 22 is rotated, the drill bit 36 digs into the formation. In this embodiment, drilling gas, represented by arrow 38, is supplied down the annulus 40 between the outer housing and the inner drill string 34 to serve as a drilling fluid for the drill bit 36. Drill cuttings and gas, represented by arrow 42, return to the surface through an inner bore 44 of the inner drill string 34. The concentric drill string 22 and drilling gas 38 prevent surrounding formations that might contain coal, fuel gases, such as methane, or other desirable substances, represented generally by reference numeral 46, from being contaminated and/or damaged by drilling mud.

Figure 2:
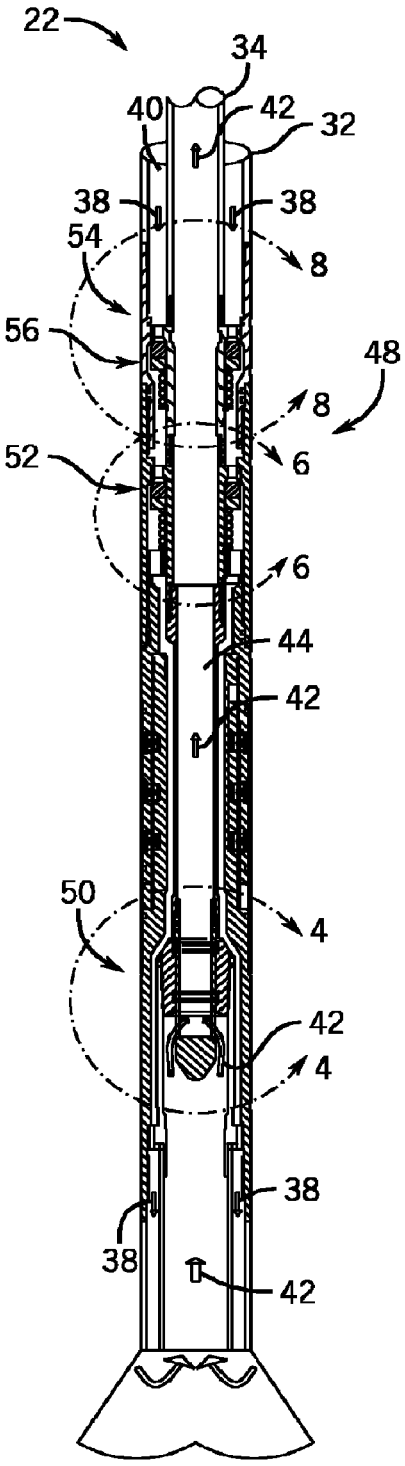
FIG. 2 is a cross-sectional view of a portion of a concentric drill string having a primary safety valve, a primary annulus safety valve, and a backup annulus safety valve with the valves in an open configuration, in accordance with an exemplary embodiment of the present technique.

Referring generally to FIG. 2, in this embodiment, the drill string 22 has a primary flow control assembly 48 having a primary inner bore shutoff valve assembly 50 and a primary annulus shutoff valve assembly 52. The primary inner bore shutoff valve assembly 50 is adapted to be selectively opened or closed to control the flow of fluids and/or particles through the inner bore 44 of the concentric drill string 22. When open, the primary inner bore shutoff valve assembly 50 enables gas and drill cuttings 42 to flow through the primary inner bore shutoff valve assembly 50 and on to the surface via the inner bore 44 of the concentric drill string 22. When closed, the primary inner bore shutoff valve assembly 50 blocks the flow of fluids through the primary inner bore shutoff valve assembly 50, thereby preventing the return of drilling gas and cuttings 42 to the surface via the inner bore 44 of the concentric drill string 22.

The primary inner bore shutoff valve assembly 50 may be closed to contain an inrush of fluid into the well from a surrounding formation, such as may occur when the formation fluid causes the wellbore pressure to be greater than the pressure of the drilling gas 38 supplied down the drill string 22. In this embodiment, the primary inner bore shutoff valve assembly is closed by lifting inner drill string 34 and rotating it relative to the outer housing 32. However, other techniques may be used.

The primary annulus shutoff valve assembly 52 is adapted to close when the drilling gas 38 pressure falls below a threshold amount above the wellbore pressure. Thus, wellbore fluids are prevented from escaping the well via the annulus 40 of the drill string 22 when there is an inrush of fluids into the wellbore from the surrounding formation.

In addition to the primary flow control system 48, the illustrated embodiment of the concentric drill string 22 also comprises a backup flow control system 54. The backup flow control system 54 provides a double-barrier to formation fluids. The backup flow control system comprises a backup annulus shutoff valve assembly 56. The backup annulus shutoff valve assembly 56 is disposed within the drill string 22 to serve as a backup to the primary annulus shutoff valve assembly 52 to block flow through the annulus 40 in the event that the primary annulus shutoff valve assembly 52 fails to close as desired.

In FIG. 2, the primary inner bore shutoff valve assembly 50, the primary annulus shutoff valve assembly 52, and the backup annulus shutoff valve assembly 56 are presented in the open configuration. Thus, drilling gas 38 flows down the annulus 40 of the concentric drill string 22 through the primary annulus shutoff valve assembly 52 and the backup annulus shutoff valve assembly 56 to the drill bit 36. Drill cuttings and gas 42 flow to the surface from the drill bit 36 via the primary inner bore shutoff valve assembly 50 and the inner bore 44 of the concentric drill string 22.

Figure 3:
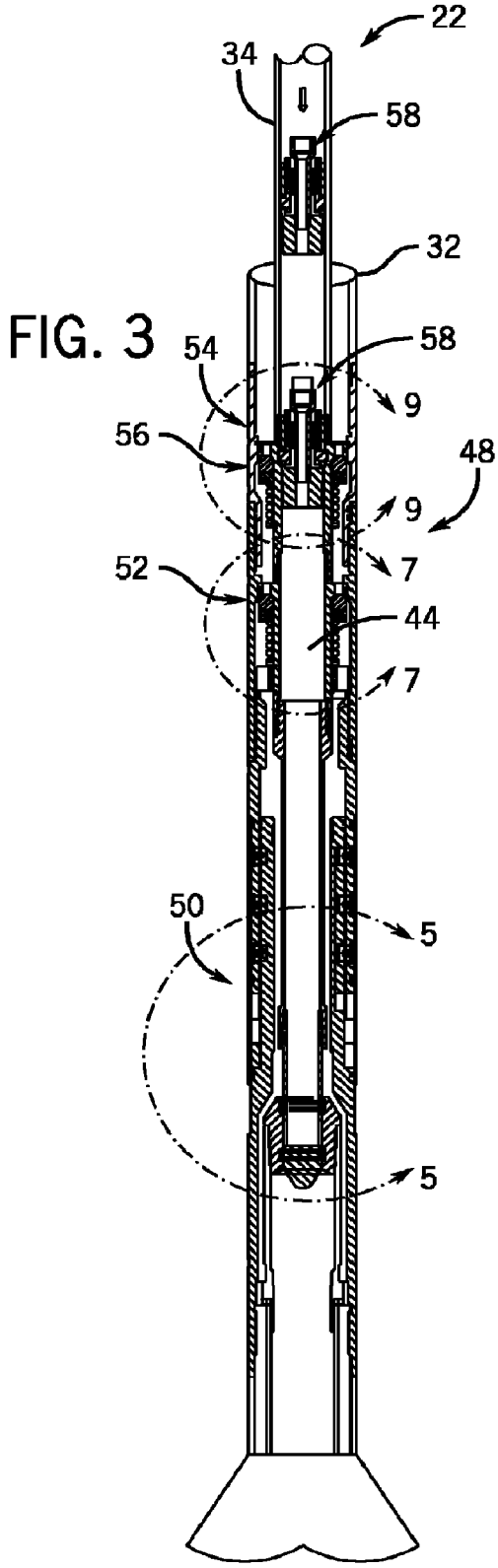
FIG. 3 is a cross-sectional view of a portion of a concentric drill string having a primary inner bore shutoff valve, a primary annulus shutoff valve, and a backup annulus shutoff valve with the valves in a closed configuration and with a backup inner bore shutoff valve installed in the concentric drill string, in accordance with an exemplary embodiment of the present technique.

Referring generally to FIG. 3, the primary annulus shutoff valve assembly 52, and the backup annulus shutoff valve assembly 56 may also be closed to prevent fluids from flowing through the drill string 22. In the illustrated embodiment, the backup flow control system 54 also comprises a backup inner bore shutoff valve assembly 58 that may be dropped into the backup annulus shutoff valve 56 through the inner bore 44 to block flow through the inner bore 44 of the concentric drill string 22. For example, if an inrush of formation fluid is detected, the primary inner bore shutoff valve assembly 50 may be closed to block fluid flow. If there is an indication that fluid is leaking by the primary inner bore shutoff valve assembly 50, or simply as a precaution, the backup inner bore shutoff valve 58 may be dropped into the inner bore 44 to further isolate the formation fluids.

Figure 4:
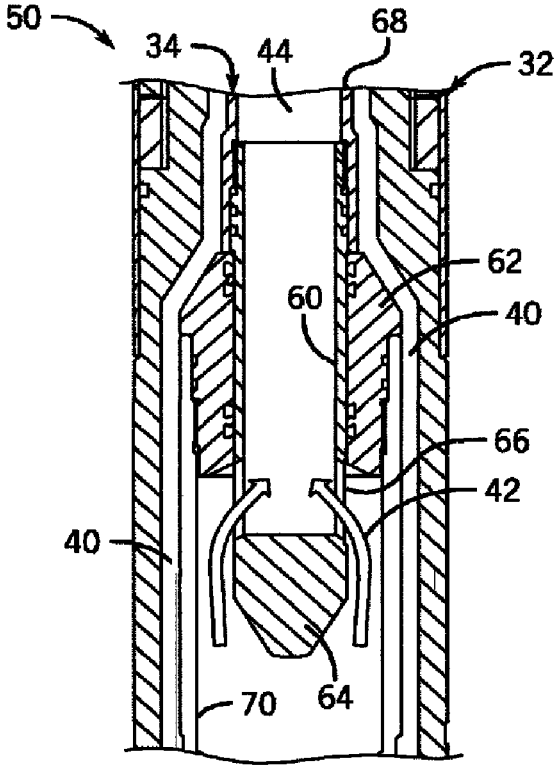
FIG. 4 is a detailed view of the primary inner bore shutoff valve in the open configuration, taken generally along lines 4-4 of FIG. 2, in accordance with an exemplary embodiment of the present technique.
Figure 5:
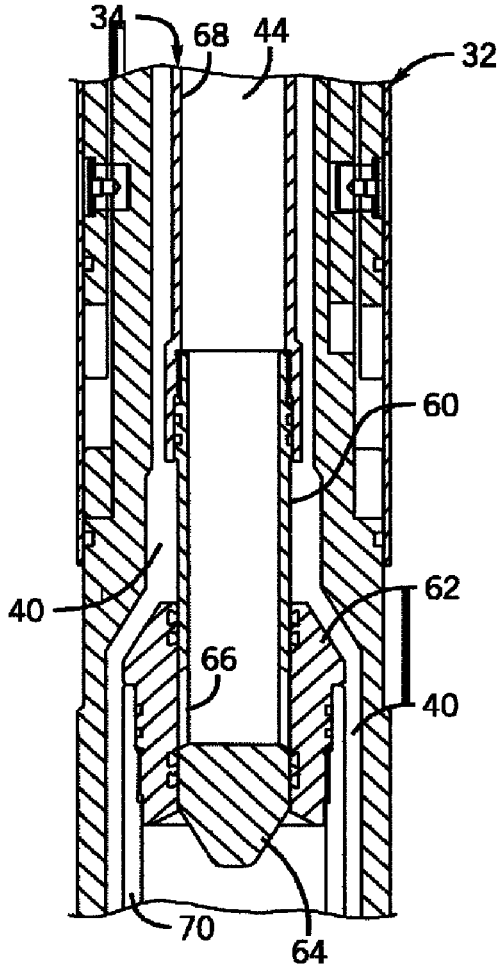
FIG. 5 is a detailed view of the primary inner bore shutoff valve in the closed configuration, taken generally along lines 5-5 of FIG. 3, in accordance with an exemplary embodiment of the present technique.

Referring generally to FIGS. 4 and 5, the primary inner bore shutoff valve assembly 50 comprises a valve member 60 and a valve sleeve 62 that are adapted to control flow through the primary inner bore shutoff valve assembly 50 and, thus, the inner bore 44. As best seen in FIG. 4, the illustrated embodiment of the valve member 60 comprises a generally hollow cylinder with a closed end 64 and a series of ports 66 disposed circumferentially around the valve member 60 to enable drill gas and cuttings 42 to enter the hollow interior of the valve member 60. As best seen in FIG. 5, the valve member 60 and valve sleeve 62 may be positioned relative to each other such that the valve member 60 blocks the ports 66 of the valve member 60, thereby preventing drill gas and cuttings 42 from entering the valve member 60. In this embodiment, the position of the valve sleeve 62 relative to the concentric drill string 22 is fixed and the valve member 60 is selectively positionable relative to the valve sleeve 62.

The illustrated embodiment of the primary inner bore shutoff valve assembly 50 also comprises an inner member 68 and an extension 70. The inner member 68 couples the valve member 60 to other portions of the inner drill string 34. The extension 70 extends downward from the valve sleeve 62 to define the inner housing and inner bore 44 below the primary inner bore shutoff valve assembly 50.

Figure 6:
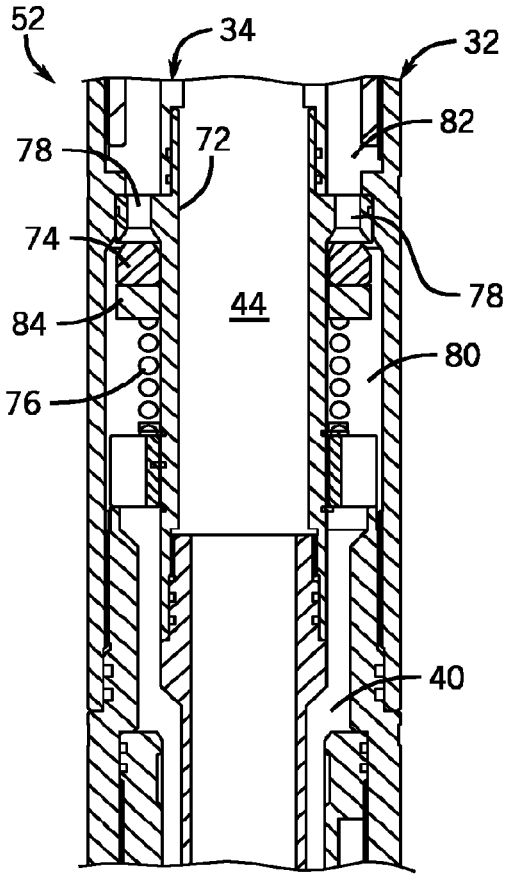
FIG. 6 is a detailed view of the primary annulus shutoff valve in the open configuration, taken generally along lines 6-6 of FIG. 2, in accordance with an exemplary embodiment of the present technique.
Figure 7:
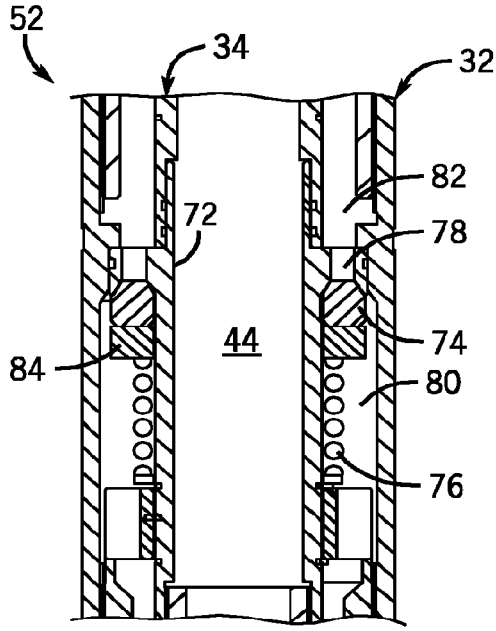
FIG. 7 is a detailed view of the primary annulus shutoff valve in the closed configuration, taken generally along lines 7-7 of FIG. 3, in accordance with an exemplary embodiment of the present technique.

Referring generally to FIGS. 6 and 7, the primary annulus shutoff valve assembly 52 comprises a primary annulus shutoff valve member 72, a valve piston 74, and a valve spring 76 that cooperate to control the flow of fluid through the primary annulus shutoff valve assembly 52 and, thus, the annulus 40. The primary annulus shutoff valve member 72 has a series of passageways 78 that define a lower annular valve chamber 80 below the passageways 78 and an upper annular valve chamber 82 above the passageways 78. The valve piston 74 is located in the lower annular valve chamber 80. The valve piston 74 is supported by a spring plate 84 and is biased by the valve spring 76 to a position against the a primary annulus shutoff valve member 72, such that the valve piston 74 blocks the passageways 78 through the valve member 72.

As best seen in FIG. 6, the valve piston 74 is driven downward when the drilling gas 38 pressure in the upper annular valve chamber 82 exceeds the sum of the downhole well pressure in the lower annular chamber 80 and the threshold pressure needed to overcome the biasing force of the valve spring 76, opening a path for fluid to flow through the series of passageways 78.

However, as seen in FIG. 7, in the event that the pressure in the upper annular valve chamber 82 does not exceed the sum of the downhole well pressure in the lower annular chamber 80 and the threshold pressure needed to overcome the biasing force of the valve spring 76, such as during a kick, the valve piston 74 is driven upward to close the path for fluid to flow through the passageways 78. This prevents formation fluid from flowing up the drill string 22 during the kick.

Figure 8:
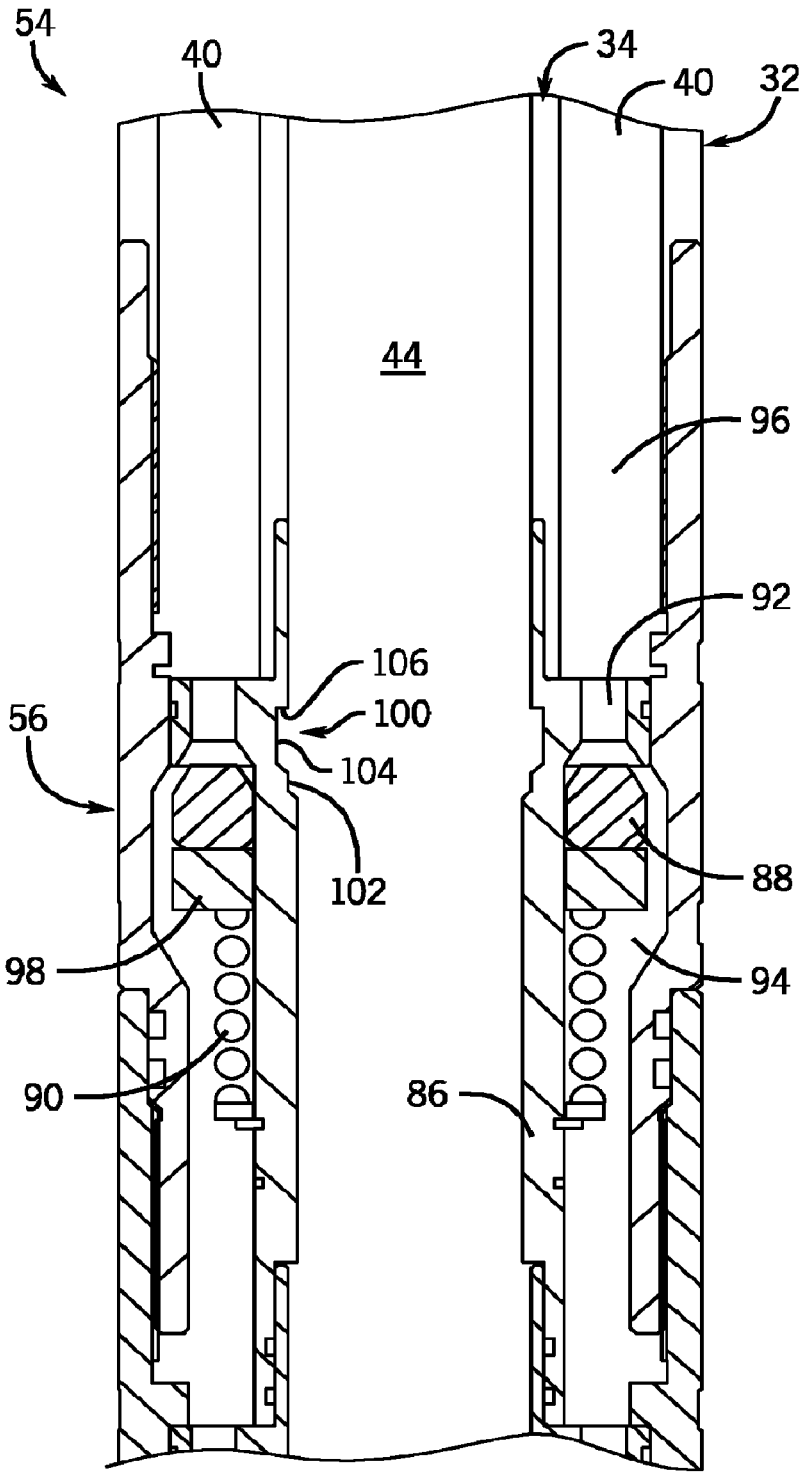
FIG. 8 is a detailed view of the backup annulus shutoff valve in the open configuration, taken generally along lines 8-8 of FIG. 2, in accordance with an exemplary embodiment of the present technique.

Referring generally to FIG. 8, the backup annulus shutoff valve assembly 56 comprises a backup annulus shutoff valve member 86, a valve piston 88, and a valve spring 90 that cooperate to control the flow of fluid through the backup annulus shutoff valve assembly 56 and, thus, the annulus 40. The backup annulus shutoff valve member 86 also has a series of passageways 92 that define a lower annular valve chamber 94 below the passageways 92 and an upper annular valve chamber 96 above the passageways 92. The valve piston 88 is located in the lower annular valve chamber 94. The valve piston 88 is supported by a spring plate 98 and is biased by the valve spring 90 to a position against the backup annulus shutoff valve member 86, such that the valve piston 88 blocks the passageways 92 through the valve member 86.

The valve piston 88 is driven downward when the drilling gas 38 pressure in the upper annular valve chamber 96 exceeds the sum of the downhole well pressure in the lower annular chamber 94 and the threshold pressure needed to overcome the biasing force of the valve spring 90, opening a path for fluid to flow through the series of passageways 92. In the event that the pressure in the upper annular valve chamber 96 does not exceed the sum of the downhole well pressure in the lower annular chamber 94 and the threshold pressure needed to overcome the biasing force of the valve spring 90, such as during a kick, the valve piston 88 is driven upward to close the path for fluid to flow through the passageways 92. This prevents formation fluid from flowing up the drill string 22 during the kick.

The backup annulus shutoff valve member 86 comprises a recessed profile 100 that is configured to receive and secure the backup inner bore shutoff valve assembly 58 to the backup annulus shutoff valve assembly 56. In the illustrated embodiment, the profile 100 comprises a lower shoulder 102, a cylindrical portion 104, and an upper stop shoulder 106.

Figure 9:
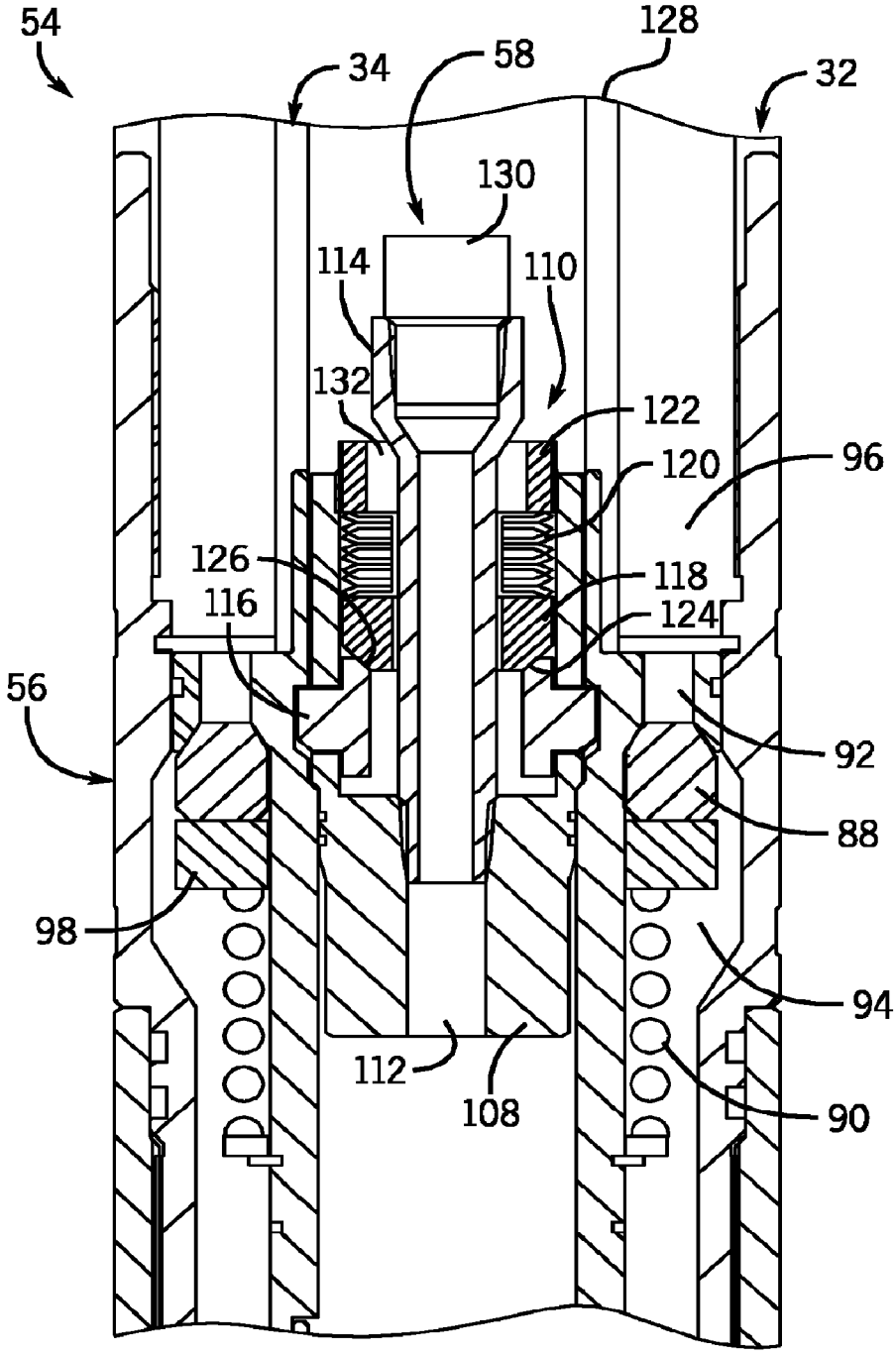
FIG. 9 is a detailed view of the backup inner bore shutoff valve installed in the concentric drill string, taken generally along lines 9-9 of FIG. 3, in accordance with an exemplary embodiment of the present technique.
Figure 10:
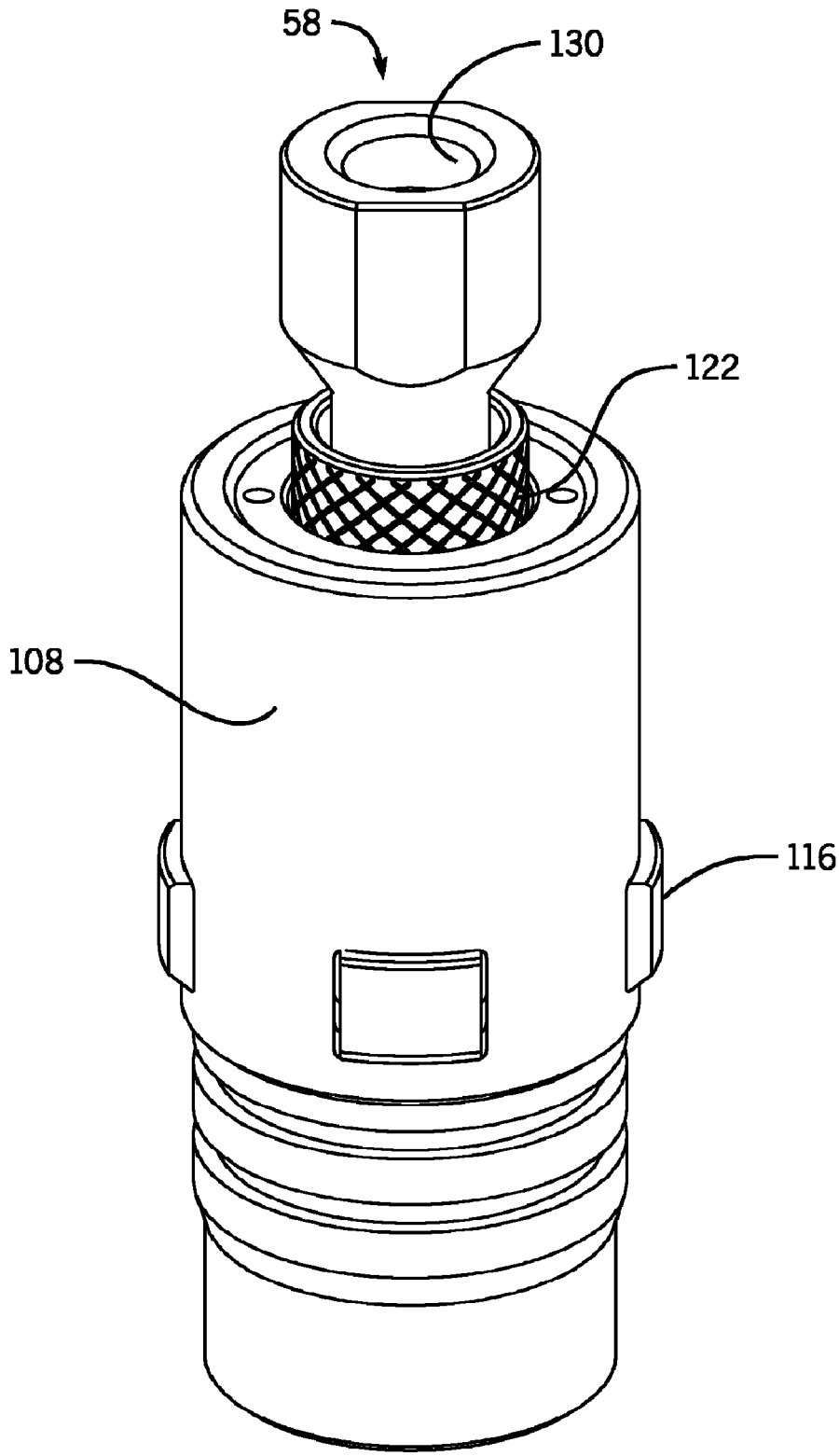
FIG. 10 is an elevation view of the backup inner bore shutoff valve, in accordance with an exemplary embodiment of the present technique.

Referring generally to FIGS. 9 and 10, the backup inner bore shutoff valve 58 is dropped into the inner bore 44 of the drill string 22 from the surface. In the illustrated embodiment, gravity is used to pull the backup inner bore shutoff valve 58 downward through the inner bore of the drill string until it lands inside the backup annulus shutoff valve 56. The backup inner bore shutoff valve 58 is adapted to enable fluids to flow around the exterior of the backup inner bore shutoff valve 58 as it is dropping into position. However, if gravity is insufficient to enable the backup inner bore shutoff valve 58 to lower to the desired position, a pump may be used to pressurize the inner bore of the drill string from the surface and drive the backup inner bore shutoff valve 58 downward to its desired position. Once the backup inner bore shutoff valve 58 lands in the backup annulus shutoff valve assembly 56, the backup inner bore shutoff valve 58 provides a second barrier to fluid flow through the inner bore 44 of the drill string 22.

The illustrated embodiment of the backup inner bore shutoff valve 58 comprises a valve body 108 having a spring-biased locking system 110 to hold the backup inner bore shutoff valve 58 within the profile 100 of the backup annulus shutoff valve 56. However, the profile 100 may be located in a different drill string component. The valve body has an inner bore 112 in which a movable stem 114 of the spring-biased locking system 110 is housed. The spring-biased locking system 110 also comprises tabs 116 disposed around the valve body 108 which are configured to land in the profile 100 of the backup annulus shutoff valve 56. The spring-biased locking system 110 is adapted to drive the tabs 116 outward. The spring-biased locking system 110 comprises a tapered ring 118, a spring 120, and a locking ring 122. In this embodiment, the locking ring 122 is threaded into the valve body 108 and serves as a shoulder for the spring 120 to drive the tapered ring 118 downward. The tapered ring 118 has a tapered bottom surface 124 configured to correspond with a tapered surface 126 on the tabs 116. As the tapered ring 126 is driven downward, it drives the tabs 116 outward. The valve stem 114 guides the movement of the tapered ring 118, a spring 120, and a locking ring 122.

As the backup inner bore shutoff valve 58 is lowered down the drill string 22, the tabs 116 are constrained by the inner wall 128 of the inner drill string. However, when the tabs 116 reach the profile 100 in the backup annulus shutoff valve 56, the spring-biased locking system 110 drive the tabs outward into the profile 100, securing the backup inner bore shutoff valve 58 within the backup annulus shutoff valve 56. Void spaces are formed between the drill string and the backup inner bore shutoff valve 58 in the regions around the circumference of the backup inner bore shutoff valve 58 between the tabs 116. These spaces enable fluid to flow by the backup inner bore shutoff valve 58 as it drops through the inner bore.

Once landed in the backup annulus shutoff valve assembly 56, the backup inner bore shutoff valve assembly 58 blocks fluid flow through the inner bore 44 of the drill string 22. In this embodiment, a threaded plug 130 is threaded into the valve stem 114 to block fluid flow through the bore 112 of the backup inner bore shutoff valve 58. Ports 132 are provided through the support ring 122 to prevent pressure from building up around the spring 120.

When wellbore pressure is brought under control, the drill string can be removed from the well so that the backup inner bore shutoff valve 58 may be removed. However, another method of removal of the backup inner bore shutoff valve 58 may be used.

While only certain features of the invention have been illustrated and described herein, many modifications and changes will occur to those skilled in the art. It is, therefore, to be understood that the appended claims are intended to cover all such modifications and changes as fall within the true spirit of the invention. For example,

The invention claimed is:

1. A drill string shutoff valve system, comprising:

a primary inner bore shutoff valve adapted to selectively control flow though an inner bore of a concentric drill string having an inner bore;

an annulus extending therethrough;

a backup inner bore shutoff valve operable to be dropped into the inner bore to control flow through the inner bore;

an annulus shutoff valve adapted to control flow through the annulus; and a backup annulus shutoff valve adapted to control flow through the annulus and to receive the backup inner bore shutoff valve.

2. The drill string shutoff valve system as recited in claim l, wherein the backup annulus shutoff valve comprises an inner bore having a profile adapted to receive a projecting member from the backup inner bore shutoff valve.

3. The drill string shutoff valve system as recited in claim 1, wherein the backup inner bore shutoff valve comprises a spring-loaded projecting member.

4. A drill string shutoff valve system for a concentric drill string having an inner bore and an annulus extending therethrough, comprising:

an inner bore shutoff valve member adapted to be dropped into the drill string shutoff valve system from above to block flow through the inner bore of the concentric drill string, the inner bore shutoff valve member comprising a spring-loaded projecting member; and an annulus shutoff valve adapted to control flow through the annulus of the concentric drill string, the annulus shutoff valve comprising:

an annulus shutoff valve member defining the inner bore of the concentric drill string, the annulus shutoff valve member having an inner profile adapted to receive the projecting member of the inner bore shutoff valve member, whereupon flow through the inner bore is blocked by the inner bore shutoff valve member; and a spring-loaded annular piston adapted to control flow through the annulus of the concentric drill string.

* * * * *